US011161337B2

(12) United States Patent
Kang et al.

(10) Patent No.: US 11,161,337 B2
(45) Date of Patent: Nov. 2, 2021

(54) LIQUID DROP DISCHARGE APPARATUS

(71) Applicant: SEMES CO., LTD., Cheonan-si (KR)

(72) Inventors: Han Lim Kang, Seoul (KR); Yoon Ok Jang, Cheonan-si (KR); Jun Seok Lee, Cheonan-si (KR); Hyun Min Lee, Gyeongsangnam-do (KR)

(73) Assignee: SEMES CO., LTD., Cheonan-si (KR)

( * ) Notice: Subject to any disclaimer, the term of this patent is extended or adjusted under 35 U.S.C. 154(b) by 0 days.

(21) Appl. No.: 16/920,359

(22) Filed: Jul. 2, 2020

(65) Prior Publication Data

US 2021/0001626 A1 Jan. 7, 2021

(30) Foreign Application Priority Data

Jul. 4, 2019 (KR) ..... 10-2019-0080723

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS 10,807,358 B2 * 10/2020 Byun ..... B41J 2/04508
2018/0147834 A1 5/2018 Jang

FOREIGN PATENT DOCUMENTS

JP 2013-063371 4/2013
KR 10-2011-0012730 A1 2/2011
KR 10-208-0060898 6/2018

* cited by examiner

*Primary Examiner* — Thinh H Nguyen

(57) ABSTRACT

A liquid drop discharge apparatus is proposed. The liquid drop discharge apparatus includes: an inkjet head discharging ink to each of pixels of a substrate; a laser emitter coupled to the inkjet head, and emitting an aiming laser beam by which a discharged position of a liquid drop from the inkjet head to each of the pixels is aimed; a camera capturing an emitted position of the aiming laser beam on the substrate; and a position alignment unit aligning a position of the inkjet head on the basis of image data obtained from the shooting unit.

20 Claims, 5 Drawing Sheets

LIQUID DROP DISCHARGE APPARATUS

CROSS REFERENCE TO RELATED APPLICATION

The present application claims priority to Korean Patent Application No. 10-2019-0080723, filed on Jul. 4, 2019, the entire contents of which is incorporated by reference herein for all purposes.

BACKGROUND OF THE INVENTION

Field of the Invention

The present invention generally relates to a liquid drop discharge apparatus. More particularly, the present invention relates to a liquid drop discharge apparatus, which can be included in a substrate processing system to be used to discharge a liquid drop to a substrate.

Description of the Related Art

Generally, to manufacture an electronic circuit component or a flat panel display such as a liquid crystal display panel, electrodes or uniform patterns such as dots are required to be formed on a glass surface or a printed circuit board (PCB) by using photoresist (PR) solution or metal pastes such as copper (Cu), silver (Ag), and aluminum (Al), etc.

As the method of forming a uniform pattern on a substrate, a method of directly patterning a uniform pattern in an offset printing method by using two rolls, or a method of discharging an ink drop may be used. Here, a liquid drop discharge apparatus for discharging the ink drop to the substrate is similar to a normal inkjet printer, and uses the method of directly patterning a uniform pattern on the substrate by using a nozzle.

Meanwhile, a conventional liquid drop discharge apparatus includes a plurality of inkjet heads. Ink discharged from the nozzle of each of the inkjet heads is required to accurately enter pixels of the substrate. However, since the pixels produced on the substrate are not uniform in position and size, the ink is discharged to the substrate after the position of discharging ink by the inkjet head to the substrate is finely aligned.

To this end, a separate glass for an ink discharge test, which is smaller than the substrate, is attached to the substrate, and a drop of ink is discharged to the glass for an ink discharge test. Next, a user checks by a microscope whether the ink is dropped accurately to a target position of the glass for an ink discharge test. Next, it is common to go through the process of finely aligning the position of the inkjet head.

In such a conventional method, the following various problems may occur.

First, the glass for an ink discharge test is attached to the substrate by an adhesive tape. The substrate may be damaged by such an adhesive tape, and may be difficult to be reused.

Furthermore, in order for the inkjet head to accurately discharge ink to pixels, a fine position alignment process of the inkjet head is required over the entire area of the substrate. However, since it is practically impossible to attach the glass for an ink discharge test to the entire area of the substrate in terms of time, the fine position alignment is performed over only a small portion of the substrate. Therefore, the reliability of the discharge position alignment of the inkjet head may be lowered. Accordingly, for a more precise discharge position alignment of the inkjet head, the discharge position alignment is required to be performed over the entire area of the substrate.

In addition, in the conventional method, a drop of ink is discharged to the glass for an ink discharge test, and then a user checks the ink by the naked eye. Since such a process is required to be repeatedly performed, it may take a lot of time to align the discharge position of the inkjet head. In addition, it may be difficult for a user to accurately check all of ink discharged to the glass for an ink discharge test.

Furthermore, since the glass for an ink discharge test has its own thickness (about 0.5 mm), the height of the Z axis of a gantry to which the inkjet head is mounted is required to be changed every ink discharge test. Otherwise, the nozzle of the inkjet head may collide with the glass for an ink discharge test, and may be damaged.

Document of Related Art (Patent Document 1) Korean Patent Application Publication No. 10-2011-0012730

SUMMARY OF THE INVENTION

Accordingly, the present invention has been made keeping in mind the above problems occurring in the related art, and the present invention is intended to propose a liquid drop discharge apparatus which can automatically perform the liquid drop discharge position alignment of an inkjet head.

In order to achieve the above objective, according to one aspect of the present invention, there is provided a liquid drop discharge apparatus including: an inkjet head discharging ink to each of pixels of a substrate; a laser unit coupled to the inkjet head, and emitting an aiming laser beam by which a discharged position of a liquid drop from the inkjet head to each of the pixels is aimed; a camera capturing an emitted position of the aiming laser beam on the substrate; and a position alignment unit aligning a position of the inkjet head on the basis of image data obtained from the camera.

Meanwhile, the laser unit may include: a laser generating member generating the laser; and a diffraction member located to be adjacent to the laser generating member, and diffracting the laser generated from the laser generating member in multiple directions.

Meanwhile, the laser unit may be coupled to a front side of the inkjet head relative to a direction in which the inkjet head is moved from an initial position thereof.

Meanwhile, the position alignment unit may include: an image processing part detecting the emitted position of the aiming laser beam in the image data; a distance calculator calculating a relative distance difference between the emitted position of the aiming laser beam and a target position; and a drive part changing the position and an angle of the inkjet head by the distance difference calculated by the distance calculator.

Meanwhile, the target position may be a center of the pixel.

Meanwhile, the shooting unit may be coupled to the inkjet head, or to a gantry moving the inkjet head relative to the substrate.

Meanwhile, the liquid drop discharge apparatus may further include: a liquid drop supply unit supplying the liquid drop to the inkjet head.

The liquid drop discharge apparatus according to the present invention includes the laser unit, the shooting unit, and the position alignment unit. Accordingly, the position of a liquid drop discharged from the inkjet head is aimed by the laser unit, and the shooting unit shoots the aiming laser beam, so that the position alignment unit can align the position of the inkjet head. Therefore, the liquid drop can be accurately discharged to the target position of the pixel of the substrate.

The alignment of the inkjet head is most accurately performed when a liquid drop is checked after discharging the liquid drop directly to the substrate. However, such a conventional method may cause not only monetary and time loss, but also many problems in efficiency.

However, in the liquid drop discharge apparatus according to an embodiment of the present invention, the aiming laser beam, the shooting unit, and the position alignment unit are used to finely align the position of the inkjet head before the liquid drop is discharged to the substrate. Accordingly, the inkjet head can accurately discharge the liquid drop to the target position of the pixel of the substrate.

Accordingly, in the liquid drop discharge apparatus according to the embodiment of the present invention, unlike the conventional art, the glass for an ink discharge test (not shown) is not used for the alignment of the inkjet head, so the substrate can be prevented from being damaged by an adhesive tape.

Furthermore, in the liquid drop discharge apparatus according to the embodiment of the present invention, the position alignment unit analyzes the data of an image shot by the shooting unit over the entire area of the substrate, and automatically aligns the liquid drop discharge position of the inkjet head. Additionally, in the liquid drop discharge apparatus according to the embodiment of the present invention, the position of the inkjet head which is required to be aligned is very rapidly calculated, and can be aligned instead of a user directly checking the liquid drop on the glass for an ink discharge test, thereby maximizing the efficiency and accuracy of the position alignment.

According to another aspect of the present invention, there is provided a method of a liquid drop discharge apparatus including: discharging, by an inkjet head, ink to each of pixels of a substrate, emitting, by a laser emitter, an aiming laser (i.e., an aiming laser beam) by which a discharged position of a liquid drop from the inkjet head to each of the pixels is aimed, capturing, by a camera, an emitted position of the aiming laser on the substrate, and aligning, by a processor, a position of the inkjet head on the basis of image data obtained from the camera.

According to another aspect of the present invention, there is provided a non-transitory computer-readable medium storing one or more instructions. The one or more instructions executable by one or more processors to cause a liquid drop discharge apparatus to: discharge, by an inkjet head, ink to each of pixels of a substrate, emit, by a laser emitter, an aiming laser by which a discharged position of a liquid drop from the inkjet head to each of the pixels is aimed, capture, by a camera, an emitted position of the aiming laser on the substrate, and align a position of the inkjet head on the basis of image data obtained from the camera.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Figure 1:
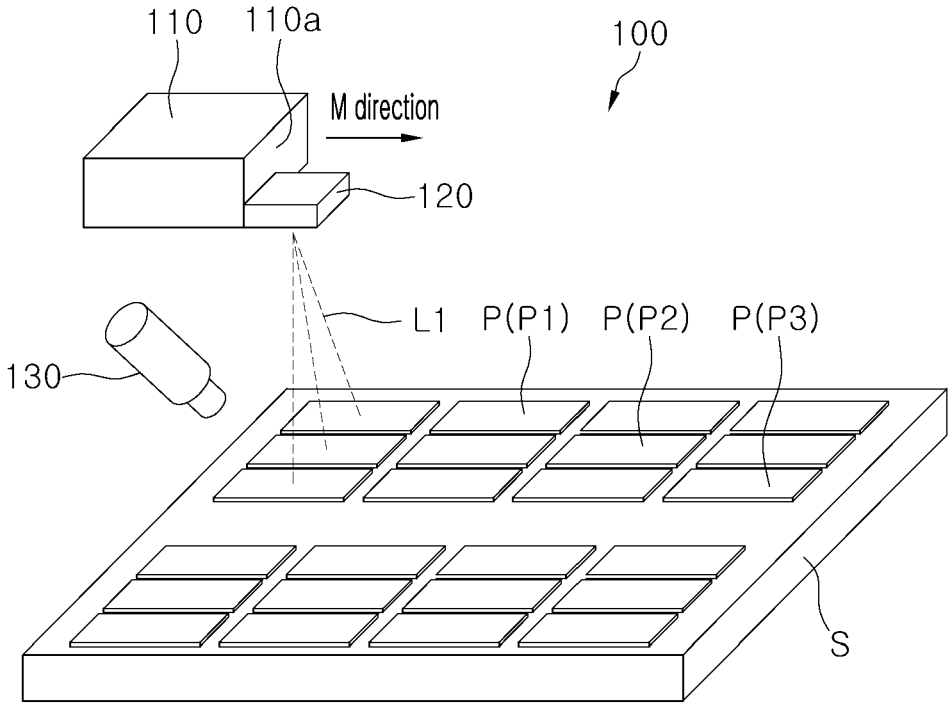
FIG. 1 is a perspective view illustrating a liquid drop discharge apparatus according to an embodiment of the present invention.

Hereinafter, an exemplary embodiment of the present invention will be described in detail with reference to the accompanying drawings so that those skilled in the art to which the present invention pertains can easily practice. The present invention can be implemented in many different forms and is not limited to the embodiment described herein.

In order to clearly describe the present invention, parts irrelevant to the description are omitted, and the same reference numerals are assigned to the same or similar elements throughout the specification.

In addition, in the embodiment, components having the same configuration will be described with the same reference numerals.

Throughout the specification, when a part is said to be "connected" to another part, this includes not only the case of being "directly connected", but also "indirectly connected" with other members interposed therebetween. Furthermore, when a part is said to "include" a certain component, this means that other components may be further included rather than excluding other components, unless otherwise stated.

Unless defined otherwise, all terms used herein, including technical or scientific terms, have the same meaning as commonly understood by a person skilled in the art to which the present invention pertains. Terms such as those defined in a commonly used dictionary should be interpreted as having meanings consistent with meanings in the context of related technologies, and should not be interpreted as ideal or excessively formal meanings unless explicitly defined in the present application.

Before describing a liquid drop discharge apparatus according to the embodiment of the present invention, a substrate processing system including the liquid drop discharge apparatus according to the embodiment of the present invention will be described.

Although not shown, a normal substrate processing system may include a stage, a gantry, a gantry moving unit, an inkjet head moving unit, a controller, a liquid-drop-discharge-amount measurement unit, a nozzle inspection unit, and an inkjet head cleaning unit.

The stage is a member on which a substrate to which a liquid drop is discharged is laid during a printing process. The gantry may be provided to be disposed on the stage. Particularly, the liquid drop discharge apparatus according to the embodiment of the present invention may be mounted to the gantry. The liquid drop discharge apparatus may be mounted to the gantry so as to be movable along a side surface thereof.

The gantry may include a member such as a rail that provides the moving path of the liquid drop discharge apparatus. Furthermore, in the substrate processing system, a plurality of the liquid drop discharge apparatuses may be mounted side by side to the gantry. For example, three liquid drop discharge apparatuses may be mounted to the gantry such that each of red, green, blue liquid drops can be discharged to the substrate.

Hereinafter, the liquid drop discharge apparatus according to the embodiment of the present invention which can be applied to the substrate processing system will be described in detail with reference to the accompanying drawings.

Figure 2:
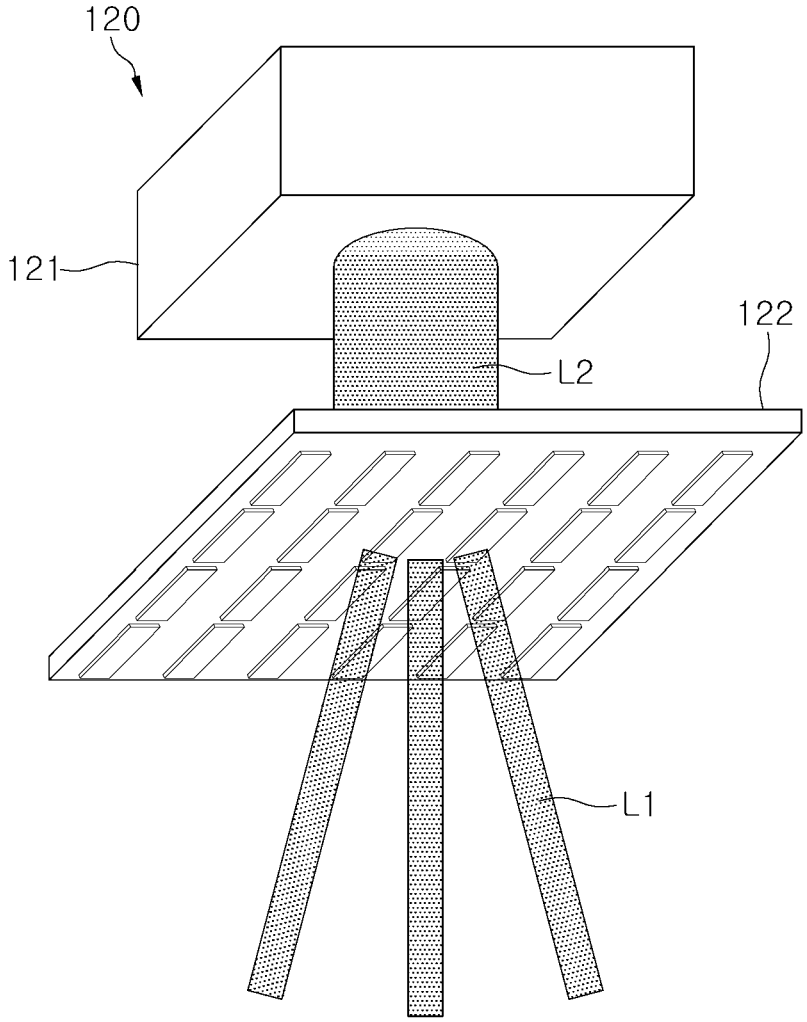
FIG. 2 is a view illustrating a laser unit selected from the liquid drop discharge apparatus of FIG. 1.

Referring to FIGS. 1 and 2, the liquid drop discharge apparatus 100 according to the embodiment of the present invention includes an inkjet head 110, a laser unit 120, a shooting unit 130, and a position alignment unit 140.

The inkjet head 110 discharges ink to each of the pixels P of the substrate S. Three pixels P1, P2, and P3 as a set can constitute a pixel. The colors of the three pixels P1, P2, and P3 may be red, green, and blue, respectively. However, the combination of the pixels may vary depending on the design of a flat panel display.

The inkjet head 110 may include a nozzle. The nozzle is located on a lower surface (a nozzle surface) of the inkjet head 110, and can discharge a liquid drop.

The inkjet head 110 may include a plurality of nozzles. The number of nozzles may be 128 or 256. The nozzles may be arranged side by side at regular pitch intervals, and can discharge liquid drops in the amount of μg unit.

Meanwhile, for example, the inkjet head 110 may include as many piezoelectric elements (not shown) as corresponding to the nozzles, and the liquid drop can be discharged through each of the nozzles by the operation of each of the piezoelectric element. For example, when the number of the nozzles is 128, the number of the piezoelectric elements may also be 128.

In addition, when the number of nozzles is 256, the number of piezoelectric elements may also be 256. Furthermore, the discharge amount of the liquid drop discharged from each of the nozzles may be independently controlled by controlling the voltage applied to each of the piezoelectric elements.

The laser unit 120 may be coupled to the inkjet head 110. The laser unit 120 can emit an aiming laser L1 toward the discharged position, on the substrate S, of the liquid drop from the inkjet head 110. The discharged position on the substrate may correspond to where a corresponding pixel is to be formed. The laser unit may be referred to as a laser emitter.

For example, the laser unit 120 may include a laser generating member 121 and a diffraction member 122.

The laser generating member 121 can generate a laser beam. The laser generating member 121 may be, for example, a laser light emitting device that generates a laser beam. The intensity of the laser generated by the laser light emitting device is preferably not an intensity sufficient to cut a target object, but an intensity sufficient to aim at a specific point of the object.

The laser unit 120 may be coupled to the front side 110*a* of the inkjet head 110 relative to a direction (an M direction) in which the inkjet head 110 is moved from an initial position thereof. More particularly, as for the process in which the substrate processing system forms patterns on the substrate S, the inkjet head 110 is moved by crossing the substrate in a longitudinal direction of the substrate or in a width direction thereof from an end of the substrate S, and the liquid drop can be discharged from the inkjet head 110.

As such, the inkjet head 110 may start from the left or right side of the substrate S and be moved to the opposite side thereof. That is, when the inkjet head 110 is moved from the left to the right of the substrate, the laser unit 120 may be coupled to the right side of the inkjet head 110, and vice versa.

The diffraction member 122 is positioned to be adjacent to the laser generating member 121 and can diffract the laser generated by the laser generating member 121 in multiple directions.

The diffraction member 122 divides one laser L2 generated by the laser generating member 121 into a plurality of laser points having uniform intervals and sizes. To this end, the diffraction member 122 may be, for example, a member in which a plurality of slits are positioned at regular intervals, or a mask including uniform pattern shapes. However, the diffraction member 122 is not limited to the above description, and may be any material that can diffract the laser.

The shooting unit 130 shoots a portion of the aiming laser L1 emitted to the substrate S. The shooting unit 130 may be coupled to the inkjet head 110. Alternately, the shooting unit 130 may be mounted to the gantry (not shown) included in the substrate processing system (not shown) and moving the inkjet head 110 relative to the substrate. However, the mounting position of the shooting unit 130 is not limited to a specific position, and may be any place of the substrate processing system as long as an emitted position of the aiming laser L1 can be easily shot.

The shooting unit 130 may be, for example, a camera. For example, such a camera may acquire image data while photographing at a high speed with a resolution of 200 megapixels or less (low resolution).

Meanwhile, the shutter speed and exposure time (shutter opening time) of the camera may be calculated by reflecting average speed at which a liquid drop is discharged (falls) and distance between the inkjet head 110 and the substrate S. The focal length of the camera may be fixed for high-speed shooting, but the focal length may also be variable depending on the distance between the inkjet head 110 and the substrate S. As long as the camera can clearly shoot an image, the focal length, shutter speed, and exposure time of the camera may be variously changed according to the design of the liquid drop discharge apparatus 100.

The position alignment unit 140 aligns the position of the inkjet head 110 on the basis of the image data obtained from the shooting unit 130. The position alignment unit may be implemented in one or more processors (or a processing circuitry).

Figure 3:
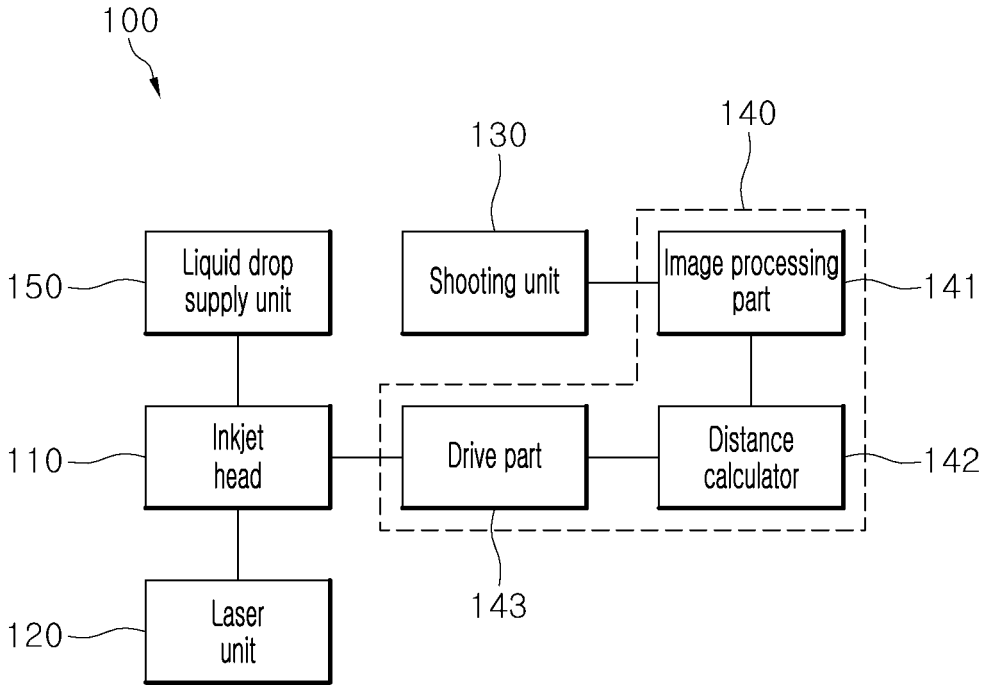
FIG. 3 is a configuration diagram illustrating the liquid drop discharge apparatus according to the embodiment of the present invention.
Figure 4:
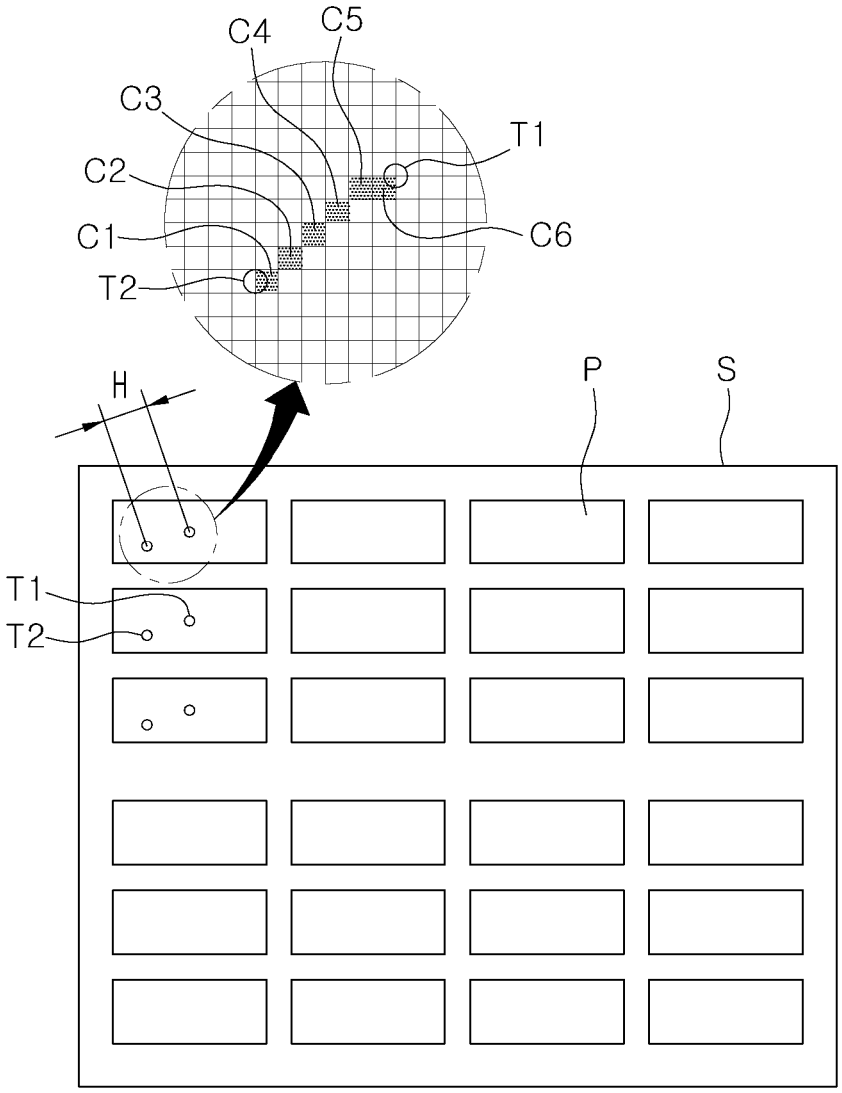
FIG. 4 is a view illustrating the state of an aiming laser emitted on a substrate.

Referring to FIGS. 3 and 4, the position alignment unit 140 may include, for example, an image processing part 141, a distance calculator 142, and a drive part 143.

The image processing part 141 can detect the emitted position T2 of the aiming laser in the image data. Such an image processing part 141 may be, for example, a graphics processing unit (GPU).

The GPU is a specialized electronic circuit designed to accelerate the generation of images inside a frame buffer to be output to a screen by rapidly processing and changing memory. Such an image processing part 141 can rapidly detect the emitted position T2 of the aiming laser in the image data by using various algorithms.

The distance calculator 142 can calculate a relative distance difference between the emitted position T2 of the aiming laser and a target position T1. For example, in the operation process of the distance calculator 142, the number of pixels C1, C2, C3, C4, C5, and C6 between the pixel of the emitted position T2 of the aiming laser and the pixel of the target position T1 in the image data is counted, and a distance between the emitted position T2 of the aiming laser and the target position T1 can be calculated on the basis of the ratio of a pixel to an actual distance (such as a nanometer or a micrometer). Accordingly, since measuring the actual distance on the basis of the pixels of the image data may be used in a normal image processing method, a detailed description thereof will be omitted, and various methods other than the above-described method may be used. In an exemplary embodiment, the distance calculator 142 may correspond to a central processing unit (CPU) or a control circuit to calculate the relative distance. In an exemplary embodiment, the distance calculator 142 and the image processing part 141 may be integrated as a system on a chip (SOC) device or a single packaged device.

Here, the target position T1 may be the center of the pixel P. Alternatively, the target position T1 may be a specific position of the pixel P to which the liquid drop is required to be discharged. The target position T1 may be different depending on the design of the substrate processing system, and may vary depending on the spreadability of the ink discharged to the pixel, so the target position is not limited to a specific position. However, for convenience of description, the target position T1 will be described by being limited to the center of the pixel P.

The drive part 143 can change the position and angle of the inkjet head 110 by distance difference H calculated by the distance calculator 142. That is, the drive part 143 can align the position of the inkjet head 110. To this end, the drive part 143 can move the inkjet head 110 in X-axis and Y-axis directions.

Figure 5:
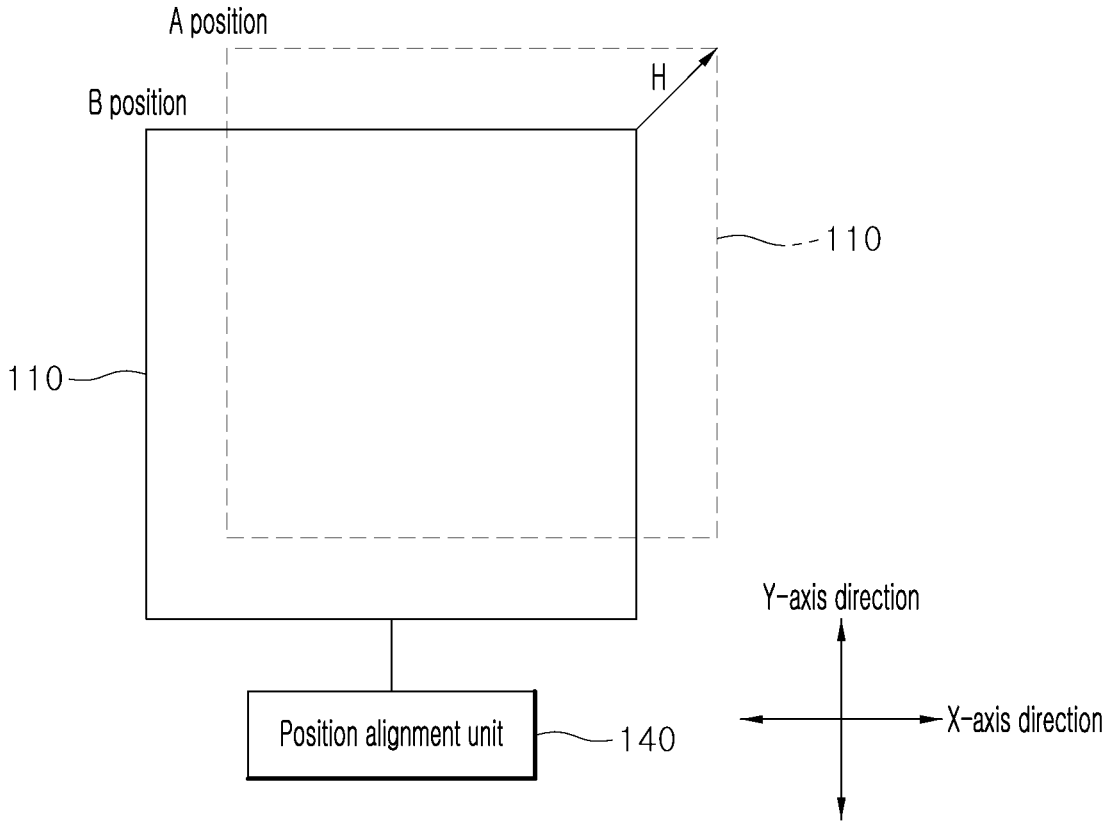
FIG. 5 is a view illustrating a process in which the position of an inkjet head is aligned.

Now, the operation of the drive part 143 will be described referring to FIG. 5. The drive part 143 can move the inkjet head 110 from an A position to a B position by the distance difference H calculated by the distance calculator 142. Since the drive part 143 may be included in a normal liquid drop discharge apparatus, detailed description thereof will be omitted.

As described above, the position alignment of the inkjet head 110 may be performed by the position alignment unit 140, and a liquid drop discharged from the inkjet head 110 may be discharged to the target position T1.

Referring back to FIG. 3, the liquid drop discharge apparatus 100 according to the embodiment of the present invention will be described in more detail. The liquid drop discharge apparatus 100 may include a liquid drop supply unit 150.

The liquid drop supply unit 150 can supply a liquid drop to the inkjet head 110. Although not shown, the liquid drop supply unit 150 may include a storage tank in which the liquid drop is stored, and a pump for pumping the liquid drop. Since the liquid drop supply unit 150 may be included in a normal liquid drop discharge apparatus, detailed description thereof will be omitted.

As described above, the liquid drop discharge apparatus 100 according to the embodiment of the present invention includes the laser unit 120, the shooting unit 130, and the position alignment unit 140. Accordingly, the position of the liquid drop discharged from the inkjet head 110 is aimed by the laser unit 120, and the shooting unit 130 shoots the aiming laser L1, so that the position alignment unit 140 can align the position of the inkjet head 110. Therefore, the liquid drop can be accurately discharged to the target position T1 of the pixel P of the substrate S.

The alignment of the inkjet head is most accurately performed when a liquid drop is checked after discharging the liquid drop directly to the substrate. However, such a conventional method may cause not only monetary and time loss, but also many problems in efficiency.

However, in the liquid drop discharge apparatus 100 according to the embodiment of the present invention, the aiming laser L1, the shooting unit 130, and the position alignment unit 140 are used to finely align the position of the inkjet head 110 before the liquid drop is discharged to the substrate S. Accordingly, the inkjet head 110 can accurately discharge the liquid drop to the target position T1 of the pixel P of the substrate S.

Accordingly, in the liquid drop discharge apparatus 100 according to the embodiment of the present invention, unlike the conventional invention, the glass for an ink discharge test (not shown) is not used for the alignment of the inkjet head 110, so the substrate S can be prevented from being damaged by an adhesive tape.

In addition, in the liquid drop discharge apparatus 100 according to the embodiment of the present invention, the position alignment unit 140 analyzes the data of an image shot by the shooting unit 130 over the entire area of the substrate S, and automatically aligns the position of the inkjet head 110. Additionally, in the liquid drop discharge apparatus 100 according to the embodiment of the present invention, the position of the inkjet head 110 which is required to be aligned is very rapidly calculated, and can be aligned instead of a user directly checking the liquid drop on the glass for an ink discharge test, thereby maximizing the efficiency and accuracy of the position alignment.

The embodiments described in the present invention may be implemented and performed on a processor, a microprocessor, a controller, or a chip. For example, functional units illustrated in each drawing may be implemented and performed on a computer, the processor, the microprocessor, the controller, or the chip.

According to an embodiment of the present invention, there is provided a method of a liquid drop discharge apparatus including: discharging, by an inkjet head, ink to each of pixels of a substrate, emitting, by a laser emitter, an aiming laser by which a discharged position of a liquid drop from the inkjet head to each of the pixels is aimed, capturing, by a camera, an emitted position of the aiming laser on the substrate, and aligning, by a processor, a position of the inkjet head on the basis of image data obtained from the camera.

According to an embodiment of the present invention, wherein the step of emitting the aiming laser comprises: generating, by a laser generating member, the laser; and diffracting, by a diffraction member, the laser generated from the laser generating member in multiple directions.

According to an embodiment of the present invention, wherein the laser emitter is coupled to a front side of the inkjet head relative to a direction in which the inkjet head is moved from an initial position thereof.

According to an embodiment of the present invention, wherein the step of aligning the position of the inkjet head comprises: detecting the emitted position of the aiming laser in the image data; calculating a relative distance difference between the emitted position of the aiming laser and a target position; and changing the position and an angle of the inkjet head by the distance difference calculated by the distance calculator.

According to an embodiment of the present invention, wherein the target position is a center of the pixel.

According to an embodiment of the present invention, wherein the camera is coupled to the inkjet head, or to a gantry moving the inkjet head relative to the substrate.

According to an embodiment of the present invention, further comprising: supplying the liquid drop to the inkjet head.

In addition, a processing method to which the present disclosure is applied may be produced in the form of a program executed by the computer, and may be stored in a computer-readable recording medium. data having a data structure according to the present invention may also be stored in the computer-readable recording medium. The computer-readable recording medium includes all types of storage devices and distribution storage devices storing computer-readable data. The computer-readable recording medium may include, for example, a Blu-ray disc (BD), a universal serial bus (USB), a ROM, a PROM, an EPROM, an EEPROM, a RAM, a CD-ROM, a magnetic tape, a floppy disk, and an optical data storage device.

According to another aspect of the present invention, there is provided a non-transitory computer-readable medium storing one or more instructions. The one or more instructions executable by one or more processors to cause a liquid drop discharge apparatus to: discharge, by an inkjet head, ink to each of pixels of a substrate, emit, by a laser emitter, an aiming laser by which a discharged position of a liquid drop from the inkjet head to each of the pixels is aimed, capture, by a camera, an emitted position of the aiming laser on the substrate, and align a position of the inkjet head on the basis of image data obtained from the camera.

16. The non-transitory computer-readable medium of claim 8, wherein the laser emitter is coupled to a front side of the inkjet head relative to a direction in which the inkjet head is moved from an initial position thereof.

According to an embodiment of the present invention, wherein the one or more instructions executable causes the liquid drop discharge apparatus to: detect the emitted position of the aiming laser in the image data; calculate a relative distance difference between the emitted position of the aiming laser and a target position; and change the position and an angle of the inkjet head by the distance difference calculated by the distance calculator.

According to an embodiment of the present invention, wherein the target position is a center of the pixel.

According to an embodiment of the present invention, wherein the camera is coupled to the inkjet head, or to a gantry moving the inkjet head relative to the substrate.

According to an embodiment of the present invention, wherein the one or more instructions executable causes the liquid drop discharge apparatus to supplying the liquid drop to the inkjet head.

Although the embodiment of the present invention has been described above, the drawings referenced so far and the detailed description of the described invention are merely used for the purpose of illustrating the present invention, but are not used to limit meaning or the scope of the present invention described in the scope of claims.

Therefore, those skilled in the art will appreciate that various modifications, additions and substitutions are possible, without departing from the scope and spirit of the invention as disclosed in the accompanying claims. Accordingly, the true technical protection scope of the present invention should be determined by the technical spirit of the appended claims.

What is claimed is:

1. A liquid drop discharge apparatus comprising:

an inkjet head discharging ink to each of pixels of a substrate;

a laser emitter coupled to the inkjet head and configured to emit an aiming laser beam to a target position on the substrate, wherein the target position corresponds to a discharged position of a liquid drop from the inkjet head to form a corresponding pixel of the pixels;

a camera capturing an emitted position on the substrate where the aiming laser beam reaches; and a position alignment unit aligning a position of the inkjet head on the basis of image data obtained from the camera.

2. The apparatus of claim 1, wherein the laser emitter comprises:

a laser generating a laser beam; and a diffraction member located to be adjacent to the laser, and configured to diffract the laser beam in multiple directions to generate the aiming laser beam.

3. The apparatus of claim 1, wherein the laser emitter is coupled to a front side of the inkjet head relative to a direction in which the inkjet head is moved from an initial position thereof.

4. The apparatus of claim 1, wherein the position alignment unit comprises:

an image processing part detecting the emitted position of the aiming laser beam from the image data;

a distance calculator calculating a relative distance difference between the emitted position of the aiming laser beam and the target position; and a drive part changing the position and an angle of the inkjet head by the relative distance difference calculated by the distance calculator.

5. The apparatus of claim 4, wherein the target position is a center of the corresponding pixel.

6. The apparatus of claim 1, wherein the camera is coupled to the inkjet head, or to a gantry moving the inkjet head relative to the substrate.

7. The apparatus of claim 1, further comprising:

a liquid drop supply unit supplying the liquid drop to the inkjet head.

8. A method of a liquid drop discharge apparatus, comprising:

discharging, by an inkjet head, ink to each of pixels of a substrate;

emitting, by a laser emitter, an aiming laser beam to a target position on the substrate, wherein the target position corresponds to a discharged position of a liquid drop from the inkjet head to form a corresponding pixel of the pixels;

capturing, by a camera, an emitted position of the aiming laser beam on the substrate; and aligning, by a processor, a position of the inkjet head on the basis of image data obtained from the camera.

9. The method of claim 8, wherein the step of emitting the aiming laser beam comprises:

generating, by a laser, a laser beam; and diffracting, by a diffraction member, the laser beam generated from the laser in multiple directions.

10. The method of claim 8, wherein the laser emitter is coupled to a front side of the inkjet head relative to a direction in which the inkjet head is moved from an initial position thereof.

11. The method of claim 8, wherein the step of aligning the position of the inkjet head comprises:

detecting the emitted position of the aiming laser beam from the image data;

calculating a relative distance difference between the emitted position of the aiming laser beam and the target position; and changing the position and an angle of the inkjet head by the relative distance difference.

12. The method of claim 11, wherein the target position is a center of the corresponding pixel.

13. The method of claim 8, wherein the camera is coupled to the inkjet head, or to a gantry moving the inkjet head relative to the substrate.

14. The method of claim 8, further comprising:

supplying the liquid drop to the inkjet head.

15. A non-transitory computer-readable medium storing one or more instructions, wherein the one or more instructions are executable by one or more processors to cause a liquid drop discharge apparatus to:

discharge, by an inkjet head, ink to each of pixels of a substrate;

emit, by a laser emitter, an aiming laser beam to a target position on the substrate, wherein the target position corresponds to a discharged position of a liquid drop from the inkjet head to form a corresponding pixel of the pixels;

capture, by a camera, an emitted position of the aiming laser beam on the substrate; and align a position of the inkjet head on the basis of image data obtained from the camera.

16. The non-transitory computer-readable medium of claim 15, wherein the laser emitter is coupled to a front side of the inkjet head relative to a direction in which the inkjet head is moved from an initial position thereof.

17. The non-transitory computer-readable medium of claim 15, wherein the one or more executable instructions causes the liquid drop discharge apparatus to:

detect the emitted position of the aiming laser beam from the image data;

calculate a relative distance difference between the emitted position of the aiming laser beam and the target position; and change the position and an angle of the inkjet head by the relative distance difference.

18. The non-transitory computer-readable medium of claim 17, wherein the target position is a center of the corresponding pixel.

19. The non-transitory computer-readable medium of claim 15, wherein the camera is coupled to the inkjet head, or to a gantry moving the inkjet head relative to the substrate.

20. The non-transitory computer-readable medium of claim 15, wherein the one or more executable instructions causes the liquid drop discharge apparatus to supply the liquid drop to the inkjet head.

* * * * *